United States Patent [19]

Birch et al.

[11] Patent Number: 5,073,123

[45] **Date of Patent: * Dec. 17, 1991**

[54] SELF TERMINATING TAP CONNECTOR

[75] Inventors: Norman R. Birch, Jacobus; James G. Dunbar, Lancaster; Harold W. Kerlin, Port Royal; Wilmer L. Sheesley, Dauphin; Edward C. Vees, Camp Hill, all of Pa.

[73] Assignee: AMP Incorporated, Harrisburg, Pa.

[ * ] Notice: The portion of the term of this patent subsequent to Jul. 9, 2008 has been disclaimed.

[21] Appl. No.: 660,505

[22] Filed: Feb. 25, 1991

Related U.S. Application Data

[60] Division of Ser. No. 519,968, May 7, 1990, Pat. No. 5,030,122, which is a continuation-in-part of Ser. No. 340,979, Apr. 20, 1989, abandoned, and a continuation-in-part of Ser. No. 354,070, May 19, 1989, abandoned.

[51] Int. Cl.[5] ..... H01R 17/04; H01R 33/96

[52] U.S. Cl. ..... 439/188; 439/620

[58] Field of Search ..... 439/188, 620, 578–585, 439/63; 200/51.09, 51.1; 333/22 R, 260

[56] References Cited

U.S. PATENT DOCUMENTS

| | | | |
|---|---|---|---|
| 2,754,487 | 7/1956 | Carr et al. | 339/102 |
| 3,873,785 | 3/1975 | Lieberman | 200/51.1 |
| 3,982,803 | 9/1976 | Bennett | 339/37 |
| 4,122,416 | 10/1978 | Oblak et al. | 333/24 C |
| 4,575,694 | 3/1986 | Lapke et al. | 333/22 R |
| 4,588,249 | 5/1986 | Blichasz et al. | 339/970 |
| 4,660,921 | 4/1987 | Hauver | 329/177 R |
| 4,664,231 | 5/1987 | Sheesley et al. | 339/177 R |
| 4,687,446 | 8/1987 | Birch et al. | 439/581 |
| 4,773,879 | 9/1988 | Pauza . | |
| 4,797,121 | 1/1989 | Hayward | 439/579 |
| 4,804,339 | 2/1989 | Cohen | 439/588 |

FOREIGN PATENT DOCUMENTS 931644 8/1973 Canada .

OTHER PUBLICATIONS

Network/Premises Interconnection Products Catalog 86–780 of AMP Incorporated issued 9/86.

*Primary Examiner*—Neil Abrams

*Attorney, Agent, or Firm*—Gerald K. Kita

[57] ABSTRACT

Ends of electrical cable are joined to corresponding self terminating, shielded connectors 1, each comprising, a conductive shell 2, a dielectric support 11 in the shell 2, a conductive switch contact 5, an electrical terminal 16 intimately connected to electrical equipment with the switch contact 5 carried by the dielectric support 11 for disconnect connection to an electrical contact inserted into the shielded connector 1, and an electrical circuit element 6 in contact with the shell 2 constructed for disconnect coupling with the switch contact 5 upon withdrawal of the electrical contact from the shielded connector 1, whereby the switch contact 5 is terminated electrically to the shell 2 through the circuit element 6.

11 Claims, 2 Drawing Sheets

SELF TERMINATING TAP CONNECTOR

CROSS REFERENCE TO RELATED APPLICATIONS

This application is a division of application Ser. No. 07/519,968, filed May 7, 1990, now U.S. Pat. No. 5,030,122, in turn, a continuation-in-part of both, application Ser. No. 07/340,979, filed Apr. 20, 1989, abandoned, and application Ser. No. 07/354,070, filed May 19, 1989, abandoned.

FIELD OF THE INVENTION

The invention relates to an electrical connector assembly with signal carrying conductor for tap connection to a panel and disconnect connection to electrical contacts.

BACKGROUND OF THE INVENTION

A known cable assembly is disclosed in U.S. Pat. No. 4,773,879 comprising, an electrical cable having multiple signal carrying conductors encircled by dielectric material and by at least one conductive sheath, and ends of the cable joined to corresponding electrical connectors. The cable includes two coaxial cables, and conductive sheaths of both cables are connected to a conductive shell of a connector, and two signal transmitting conductors of the two cables are connected to a center contact of the connector that is ordinarily suited for connection to a single coaxial cable.

SUMMARY OF THE INVENTION

An advantage to the invention resides in a cable assembly and a connector that is self-terminating when an electrical contact is disconnected. A feature of the invention resides in an electrical circuit element in contact with a conductive shell of the connector constructed for disconnect coupling upon withdrawal of an electrical contact from the connector, whereby the switch contact is terminated to the shell through the circuit element.

The electrical connector assembly of the present invention comprises an electrical conductor having elongated conductive end portions and a conductive tap portion for intimate disconnect coupling to a corresponding electrical connector within the wall of a panel; a dielectric support for the conductor having dielectric portions encircling respective elongated conductive end portions and tap portion; a hollow conductive shell having individual sleeve portions and a composite sleeve portion, the individual sleeve portions abutting one another and encircling respective dielectric portions of the dielectric support; wherein, the electrical conductor comprises a conductive switch contact connected to a corresponding signal transmitting conductor and carried by the dielectric support for disconnect connection to an electrical contact inserted into the hollow conductive shell and an electrical circuit element in contact with the shell constructed for disconnect coupling with the switch contact upon withdrawal of the electrical contact from within the conductive shell, whereby the switch contact is terminated electrically to the shell through the circuit element.

Each switch contact is of unitary construction stamped and formed from a strip of metal, and comprises the following portions; a forward, sloped end, a curved contact, an elongated leaf spring and an electrical terminal in the form of a pin for disconnect coupling to a corresponding electrical connector within the wall of a panel.

These and other advantages, features and objectives of the invention are disclosed by way of example from the following detailed description and accompanying drawings.

DESCRIPTION OF THE DRAWINGS

With reference to FIGS. 1, 2 and 3, each shielded electrical connector comprises a conductive shell 2, a bipartite, dielectric support 3 for assembly in the shell 2, and for being encircled by a cylindrical portion 4 of the shell 2, a conductive switch contact 5 to be carried by the dielectric support 3, and an electrical circuit element 6, for example, a resistor, for mounting in the shell 2 and in contact with the shell 2, and constructed for disconnect coupling with the switch contact 5, whereby the switch contact 5 is terminated electrically to the shell 2 through the circuit element 6.

Figure 1:
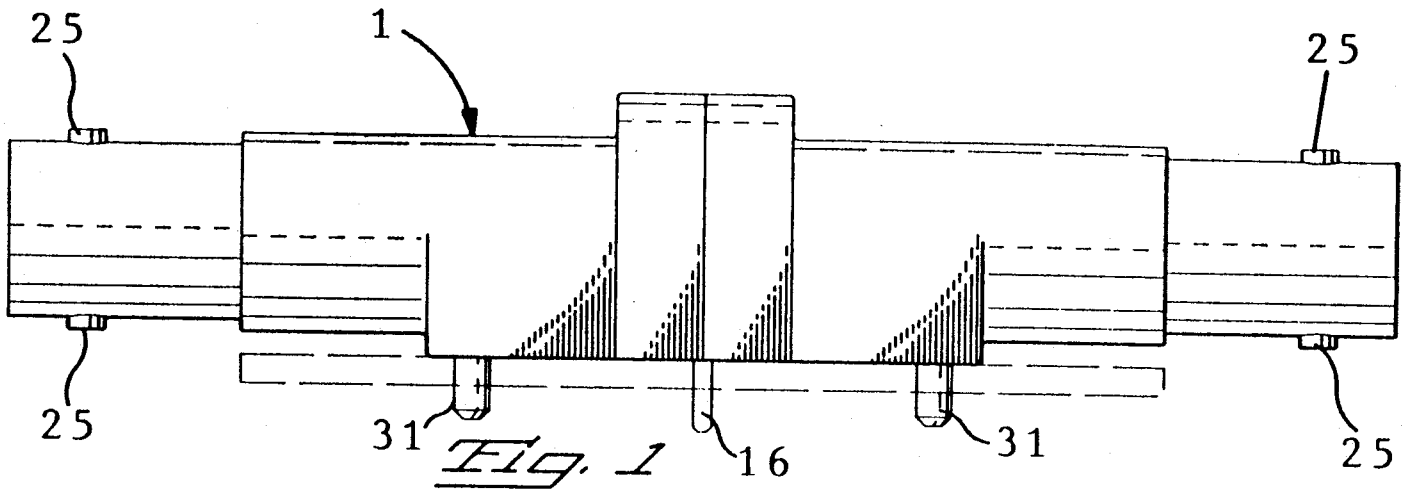
FIG. 1 is a side view of a shielded electrical connector assembly.

For example, each cylindrical portion 4 is provided with external bayonet coupling prongs 7. Each shell 2 has an open side 8 connecting along an open side 8 of another shell 2 in a manner as described in U.S. Pat. No. 4,687,446. Desirably, the shells 2 are in intimate contact without gaps to insure gap free shielding and continuous electrical paths along a shortest distance from one shell 2 to another. Semirectangular portions 9 of corresponding shells 2 connect together to form a composite rectangular portion 10. Each shielded connector 1 includes a bipartite dielectric support 11 constructed of duplicate sections 12 that separate to enable assembly with the switch contact 5 and the circuit element 6. The sections 12 face each other for assembly together in a corresponding shell 2.

Each switch contact 5 is of unitary construction, formed from a flat T-shaped metal element that may be stamped and separated from a strip of metal and which comprises the following portions, a forward, sloped end 13, a curved contact 14, an elongated leaf spring 15, and an electrical terminal 16. The electrical terminal 16 is knife-shaped to project through the panel of a housing 30 of electrical equipment. For example, the circuit element 6 is a cube of resistive material with opposite sides having corresponding conductive surfaces 17. The circuit element 6 is inserted in a recess 18 extending partially in each section 12 of the dielectric support 11. The recess 18 communicates with a corresponding shell 2. A corresponding conductive surface 17 of the circuit element 6 is against a corresponding shell 2.

A second switch contact 19 of straight, elongated construction is assembled along a corresponding passage 20 extending partially in each section 12. The passage 26 communicates with the recess 18 and with a contact receiving cavity 21 of each section 12. A corresponding end 22 of the second switch contact 19 is received in an undercut pocket 23 of each section 12 of the dielectric support 11 and is restrained from movement. The second switch contact 19 is deflected when mounted in a corresponding dielectric support 11, to bias the second switch contact 19 in pressure engagement against a corresponding conductive surface 17 of the circuit element 6. In turn, the circuit element 6 is biased to apply pressure engagement of the other conductive surface 17 against a corresponding shell 2.

For example, the circuit element 6 and the second switch contact 19 is assembled, first with one of the sections 12, followed by assembly of the switch contact 5 along a corresponding passage 24 extending in one of the sections 12. Each switch contact 5 converges into a common elbow 25 along a corresponding shaped turn 26 of the passage 24 to restrain the switch contact 5 from movement. The leaf spring 15 of each switch contact 5 extends along a corresponding cavity 21 that communicates with a corresponding passage 24, and that is spacious to permit deflection of the leaf spring 15. Each cavity 21 communicates with a corresponding front end 27 of the dielectric support 11. The sloped front end 13 of each switch contact 5 projects across the corresponding cavity 21.

Each leaf spring 15 must be deflected to be mounted along a corresponding cavity 21 of a corresponding dielectric support 11. Each deflected leaf spring 15 biases the curved contact 14 in pressure engagement against a corresponding second switch contact 19. The pressure engagement establishes an electrical circuit that electrically connects the signal terminal 16 to the switch contact 5, the circuit element 6 and a corresponding shell 2. The circuit also extends along the second switch contact 19.

Each connector 1 is intimately fitted by means of signal terminal 16 and projecting conductor pins 31 that project in the same direction as electrical terminal 16 and which serve as electrical terminals for establishing an electrical connection with the circuit board (not shown) of electrical equipment, much as described in U.S. Pat. No. 4,687,446.

A standard cable assembly 33 is constructed of a known coaxial cable 34 having a single signal transmitting conductor connected at opposite ends with plug type coaxial connectors 35 of known construction.

Figure 2:
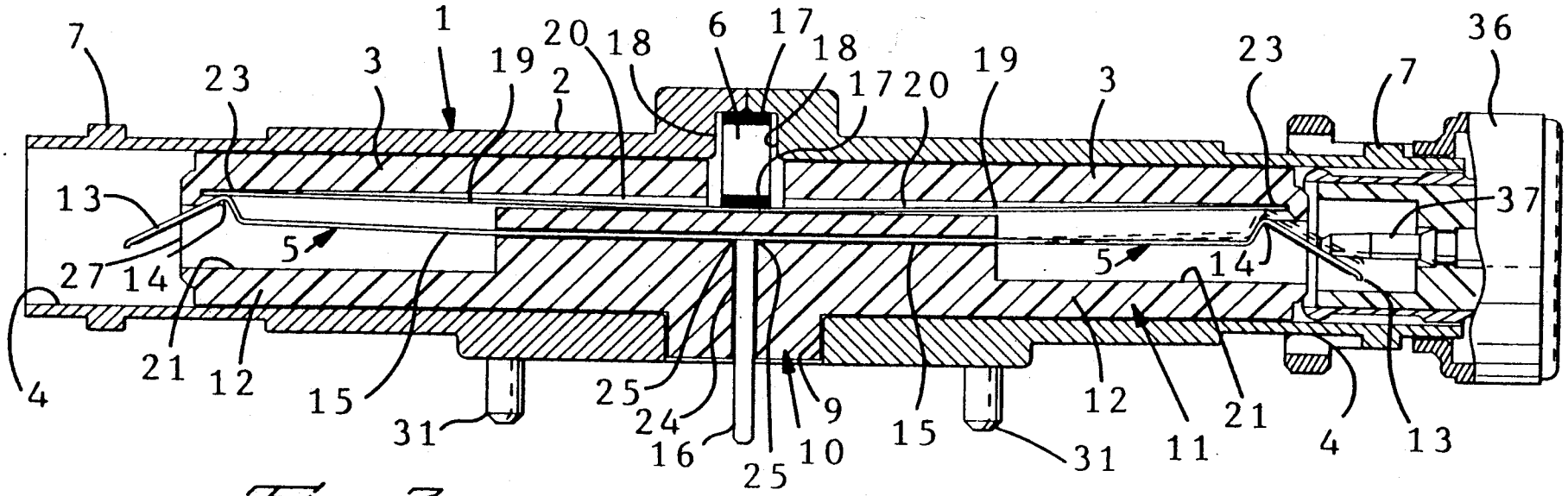
FIG. 2 is a fragmentary enlarged plan view in section of the electrical connector assembly shown in FIG. 1.
Figure 3:
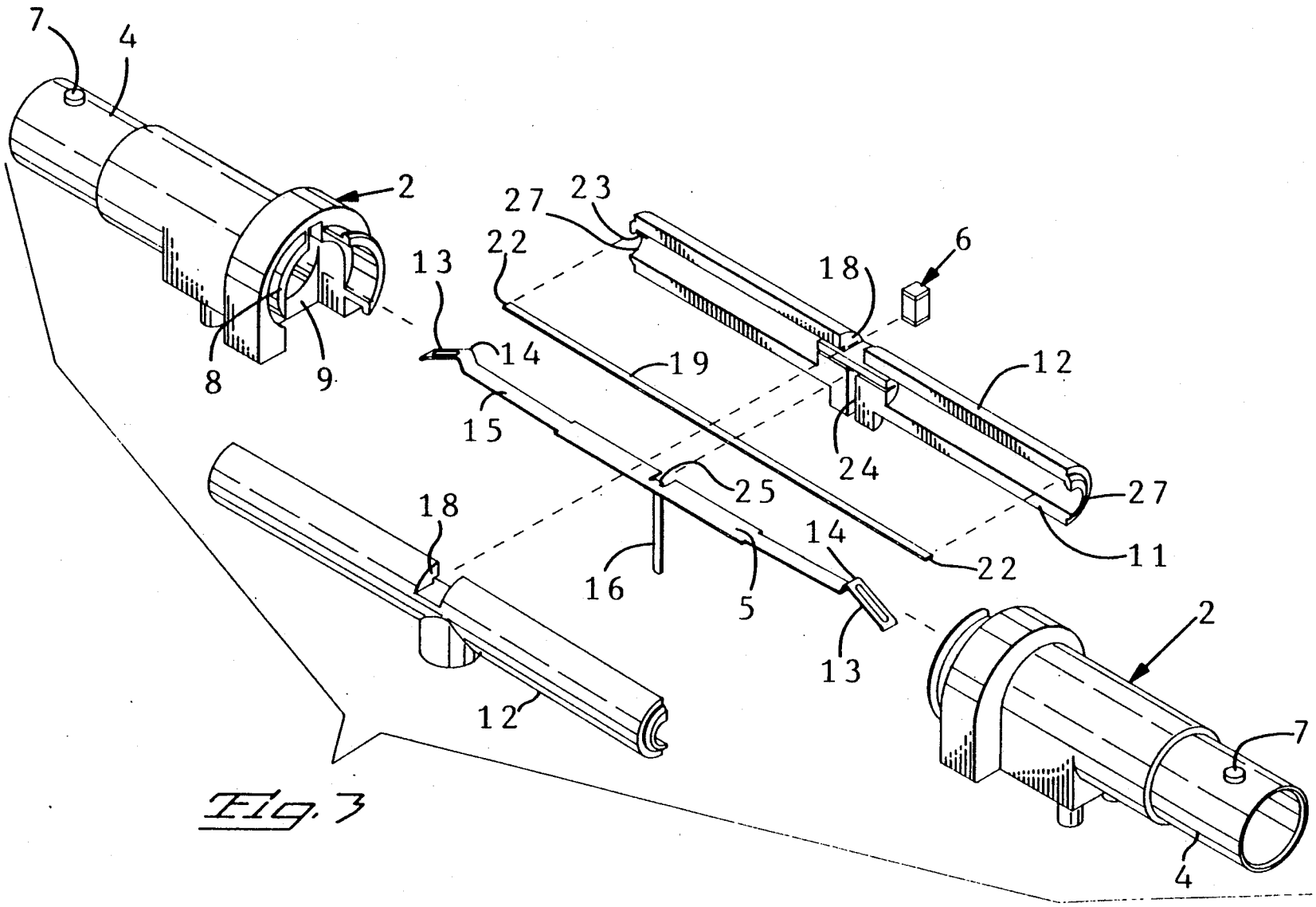
FIG. 3 is a fragmentary perspective view with parts exploded of the conductive switch contact as shown in FIG. 1.

FIG. 2 shows disconnect coupling of the standard cable assembly 33 with the shielded electrical connector 1. A bayonet coupling ring 36 of the plug type coaxial connector 35 is connected to the bayonet prongs 7 of the shielded connector 1. A signal transmitting center contact 37 of the connector engages the switch contact 5 of the shielded connector 1, thereby establishing a signal transmitting circuit that couples the respective, the switch contact 5, and the standard cable assembly 33.

With reference to FIG. 2, the center contact 37 deflects the switch contact 5 away from the second switch contact 19 to disengage the switch contact 5, and to disconnect the electrical circuit coupling the circuit element 6 with the switch contact 5. When the connector 35 of the standard cable assembly 33 is disconnected from the shielded connector 1, the conductive switch contact 5 will return by spring action to engage the second switch contact 19, thereby again establishing the circuit that couples the switch contact 5, the circuit element 6 and a corresponding shell 2. The circuit also extends along the second switch contact 19.

With reference to FIG. 2, the shielded connector 1 that is not connected with a standard cable assembly 32 is self terminating, in that the switch contact 5 is coupled to the shell 2 through a fixed impedance provided by the impedance of the circuit element 6. The self terminating, electrical connector 1 will not appear as an open circuit to transmission of a communications signal.

We claim:

1. A shielded electrical connector assembly comprising; an electrical conductor having an elongated conductive end portion and a conductive tap portion for intimate disconnect coupling to a corresponding electrical connector within the wall of a panel; a dielectric support for the conductor having dielectric portions encircling respective ones of said elongated conductive end portions and said tap portion; a hollow conductive shell having individual sleeve portions abutting one another and encircling respective said dielectric portions of the dielectric support;

wherein the electrical conductor comprises a conductive switch contact connected to a corresponding signal terminating conductor, said switch contact being carried by the dielectric support for disconnect connection to an electrical contact inserted into the hollow conductive shell, and an electrical circuit element in contact with the shell constructed for disconnect coupling with the switch contact upon withdrawal of the electrical contact from within the conductive shell, whereby the switch contact is terminated electrically to the shell through the circuit element.

2. A shielded electrical connector assembly as recited in claim 1 wherein the improvement comprises; said circuit element includes a resistive material between conductive surface contacts, one of the surface contacts being engaged against the shell.

3. A shielded electrical connector assembly as recited in claim 1 wherein the improvement comprises; the switch contact is deflected by the electrical contact to interrupt an electrical circuit between the switch contact and the circuit element.

4. A shielded electrical connector assembly as recited in claim 1 wherein the improvement comprises; an electrical conductor having a conductive second switch contact engaged against the circuit element and becoming engaged against the first recited switch contact upon withdrawal of the electrical contact from the shielded connector, and the switch contacts become disengaged from each other by insertion of the electrical contact in the shielded connector.

5. A shielded electrical connector assembly of claim 1 wherein the electrical conductor comprises; an elongated leaf spring portion, with a forward sloped end and a curved contact and a conductive tap portion, of said leaf spring portion formed by stamping a substantially T-shaped blank from a flat metal sheet and bending said tap portion 90 degrees to the plane of the stamped blank.

6. A shielded electrical connector assembly as recited in claim 1 wherein the improvement comprises; said sleeve portions of the shielded connector being connected together.

7. A shielded electrical connector assembly, comprising:

a conductive shell, a dielectric support in the shell, a conductive first switch contact in the shell carried by the dielectric support, a conductive second switch contact in the shell carried by the dielectric support, an electrical circuit element in the shell engaging the shell and being held against the shell by the second switch contact, the first switch contact being constructed for deflection to disengage from the second switch contact, the first switch contact being constructed for deflection upon uncoupling from a plug type connector to engage the second switch contact and establish a self terminating coupling to the shell through an impedance of said circuit element, the first switch contact having a projecting signal terminal for establishing an electrical connection with a circuit board, and the shell being fitted with a conductor pin projecting in the same direction as the signal terminal for establishing an electrical connection with a circuit board.

8. A shielded electrical connector assembly as recited in claim 7 wherein, the second switch contact is in pressure engagement with said circuit element.

9. A shielded electrical connector assembly as recited in claim 7 wherein, said circuit element is in a recess of said dielectric support.

10. A shielded electrical connector assembly as recited in claim 7 wherein, the second switch contact is in a pocket of the dielectric support.

11. A shielded electrical connector assembly as recited in claim 7 wherein, the first and second switch contacts extend along a cavity of the dielectric support, and the first switch contact is constructed for said deflection in the cavity.

* * * * *